United States Patent [19]

Ridings

[11] Patent Number: 4,953,666

[45] Date of Patent: Sep. 4, 1990

[54] ELEVATING APPARATUS HAVING AN OFFSET UPPER BOOM MAINTAINING A WORKSTATION LEVEL ON A CANTILEVERED ANGULARLY MOVABLE SUPPORT THAT RETRACTS INTO A COMPACT POSITION

[75] Inventor: James Ridings, Glenmoore, Pa.

[73] Assignee: Strato-Lift,Inc., Morgantown, Pa.

[21] Appl. No.: 332,291

[22] Filed: Mar. 31, 1989

[51] Int. Cl.[5] ..... B66B 9/20; B66F 11/04

[52] U.S. Cl. ..... 187/9 R; 182/2; 182/63; 182/141; 254/10 C

[58] Field of Search ..... 187/1 R, 1 A, 18, 9 R, 187/17; 182/2, 63, 141, 149; 212/182, 186; 254/10 R, 10 C, 5 R, 5 C, 2 R, 2 C; 414/700, 728

[56] References Cited

U.S. PATENT DOCUMENTS

| | | | |
|---|---|---|---|
| 3,807,575 | 4/1974 | Merrick | 212/8 |
| 3,842,933 | 10/1974 | Clark | 182/2 |
| 3,888,463 | 6/1975 | O'Brien et al. | 254/10 C |
| 3,893,540 | 7/1975 | Beucher | 182/2 |
| 4,019,604 | 4/1977 | Benson | 182/2 |
| 4,360,187 | 11/1982 | Chapman | 182/2 X |

FOREIGN PATENT DOCUMENTS

| | | | |
|---|---|---|---|
| 923050 | 3/1973 | Canada | 187/1 R |
| 990224 | 6/1976 | Canada | 187/1 R |
| 1016084 | 8/1977 | Canada | 187/1 R |

*Primary Examiner*—Andres Kashnikow
*Assistant Examiner*—Kenneth DeRosa
*Attorney, Agent, or Firm*—Dann, Dorfman, Herrell and Skillman

[57] ABSTRACT

The invention provides an elevating apparatus for raising and lowering a work station holding personnel, equipment, and/or materials between a downward declining, compact retracted position and an upwardly inclining extended limit position. The work station is connected to a mobile support base by parallelogram first and second boom assemblies which are operatively interconnected by a boom assembly coupler and rigid compression link. Thus, raising or lowering the first boom assembly by hydraulic lift means causes the second boom assembly to move correspondingly such that the work station moves vertically, unaccompanied by any substantial horizontal motion, and is maintained in a level attitude throughout the range of motion of the apparatus.

4 Claims, 3 Drawing Sheets

ELEVATING APPARATUS HAVING AN OFFSET UPPER BOOM MAINTAINING A WORKSTATION LEVEL ON A CANTILEVERED ANGULARLY MOVABLE SUPPORT THAT RETRACTS INTO A COMPACT POSITION

BACKGROUND OF THE INVENTION

This invention relates to an apparatus for raising or lowering personnel, equipment, and/or materials, and in particular an apparatus in which vertical motion is unaccompanied by any substantial horizontal motion.

Various designs employing multiple booms are known in the prior art. Some designs have employed gears, chains, or cables in the linkages which operatively connect the upper boom to the lower boom. Controlled by these linkages, elevation of the latter causes elevation of the former. Additionally, such linkages have been used to maintain the work station, which includes platforms, baskets, and buckets, in a level attitude. However, such mechanisms are complex, costly to manufacture and maintain, and require periodic adjustment by trained field personnel in order to remain properly operable.

Canadian Patent No. 1,016,084 issued to J. A. Merrick on Aug. 23, 1977 relates to an elevating device for raising platforms. The device includes first and second parallelogram linkages. In one embodiment, both the first and second parallelogram linkages are each raised and lowered by the operation of independent hydraulic cylinders. In another embodiment, Merrick replaces either of the hydraulic cylinders in the first-mentioned embodiment with a mechanical link. Thus, for instance, the patent illustrates an apparatus in which the first and second parallelogram linkages are operatively interconnected by a rigid compression link.

The movement of each parallelogram linkage by an independent hydraulic cylinder suffers at least two drawbacks. First, it is often advantageous for the work station to be movable vertically while unaccompanied by substantial horizontal movement, thus allowing accurate placement of the apparatus in the work area before elevation without the need to adjust the apparatus ground position thereafter. Where the boom assemblies are of equal length, and movable in opposite directions, this may only be achieved by simultaneously extending or retracting both boom assemblies at the same speed. In the device of the Merrick patent, careful and skillful synchronization of the hydraulic cylinders by the operator is required to accomplish this result. Alternatively, systems which automatically synchronize the hydraulic cylinders are known, however these relatively complex systems require maintainence by skilled personnel. Second, the incorporation into a design of multiple hydraulic cylinders and the relatively complex control means necessary to synchronize them undesirably increases manufacturing expense.

U.S. Pat. No. 4,019,604 issued to L. D. Benson on Apr. 26, 1977, relates to apparatus for elevating a platform, the apparatus described include a pair of lift boom assemblies which are interconnected such that the platform can be raised and lowered in a level attitude. Each boom assembly includes a pair of arms which are parallel to each other. The two lift boom assemblies are interconnected at a so-called floating frame and are operatively connected by a rigid tension link. This structure has drawbacks since the quality of welds used in tension is critical to the integrity of the tension link and especial care must be exerted in its manufacture.

The Merrick patent describes the second parallelogram linkage of one embodiment as having a "skew" or offset on each arm consisting of two bends of equal degree. The stated purpose of this skew is to prevent interference between the first linkage and the second linkage when the two are moved past each other to the retracted or stored position. Such designs are desirable in that the apparatus is foldable into a compact form for ease of stowage and transport within areas of limited height and width.

Similarly, this offset design feature is incorporated in one embodiment of the Benson patent. The lower lift boom assembly pivots downwardly from an upstanding post member supported by the mobile frame when the apparatus is being retracted. Both arms of the upper lift boom assembly are formed with an offset or "zig-zag" such that the two lift boom assemblies can be stowed side-by-side when the apparatus is in the retracted position without interfering with each other.

However, the use of an offset in both arms of a boom assembly or parallelogram linkage is less than desirable. Not only are the designs complex, they are also difficult and therefore costly to manufacture. For example, the Benson apparatus requires a plurality of welds or fasteners to maintain the structural integrity of the boom arms. Similarly, bending the arms in accordance with the Merrick patent requires costly bending processes in order to achieve the proper amount of offset.

Alternatively, the offsetting of one boom assembly from the other also has been achieved using a double floating frame. However, such a design is not advantageous because such frames are significantly heavier than their single frame counterparts, thus requiring the utilization of larger and costlier lifting means as well as enhanced means for stablizing the extended apparatus.

A difficulty encountered in utilizing a compression link in conjunction with a single floating frame to interconnect the first and second boom assemblies is that, when the compression link is pivotally connected to the upper arm or main boom of the second boom assembly, the axis of the link must necessarily intersect the axis of the lower arm of the second boom assembly. The Merrick patent describes one solution to this problem. Merrick shows a lower arm made of two parallel bars held in a spaced-apart relationship by spacers, thereby allowing the compression link to operate therebetween. However, such a design is less than satisfactory because, since it requires several parts to be fabricated, aligned, and fastened together to form the lower arm, the manufacture is costly.

SUMMARY OF THE INVENTION

It is an object of the invention to provide an improved elevating apparatus for elevating a work station, such as a platform, basket, bucket, or a support or carrier for cargo, including personnel, equipment and/or materials.

It is a further object of the invention to provide an elevating apparatus which is inexpensive to manufacture, requires minimal maintenance and field adjustment, is easily transported to and emplaced in the work area, and is readily foldable into a compact retracted or stored position for ease of transport and stowage in areas of limited height and width.

It is a further specific object of the invention to provide a work station that may be readily maintainable in a level attitude at all times, and that vertical movement of the work station be unaccompanied by substantial horizontal movement.

In accordance with the present invention there is provided an improved elevating apparatus having a work station positionable in a compact stored or retracted position and multiple extended positions, said work station being readily movable therebetween by lifting means.

In summary, the apparatus comprises a support base; an elongated first boom assembly having a pivot end and a distal end, the pivot end being pivotally connected to said support base; a lifting means operatively connected to said first boom assembly; a boom assembly coupler pivotally connected to the distal end of said first boom assembly; an elongated second boom assembly, having a pivot end and a distal end, the pivot end being pivotally connected to said boom assembly coupler and to a second control arm pivot means; a rigid compression link operatively interconnected between the distal end of said first boom assembly and the pivot end of said second boom assembly; a work station; and a work station support member, having a fixed end and a pivot end, the fixed end fixedly connected to said work station, and the pivot end pivotally connected to the distal end of said second boom assembly such that said work station remains in a level attitude throughout the range of movement of said first and second boom assemblies.

The first boom assembly is further comprised of an elongated first boom and elongated first control arm of length substantially equal thereto and in a substantially parallel relationship therewith, each having a pivot end and a distal end.

The second boom assembly is further comprised of an elongated second boom, having a pivot end and a distal end, and a second control arm assembly. The second control arm assembly includes an elongated, straight second control arm, having a pivot end and a distal end, and second control arm pivot means for pivotally connecting the pivot end of said second control arm to said boom assembly coupler in an offset manner.

BRIEF DESCRIPTION OF THE DRAWINGS

The foregoing summary and the following detailed description of the invention will be better understood when read in conjunction with the accompanying drawings, in which.

DETAILED DESCRIPTION OF THE INVENTION

Figure 1:
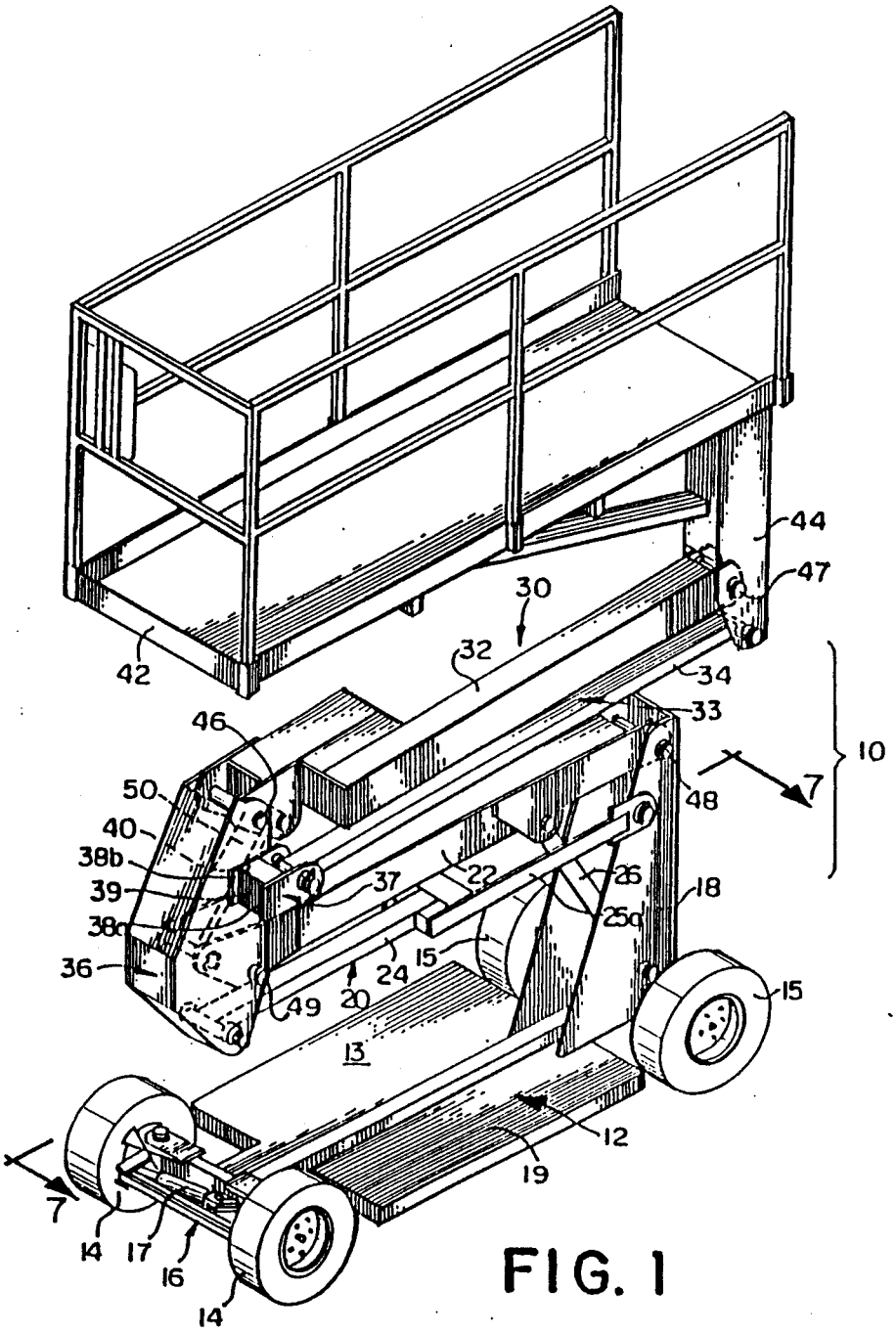
FIG. 1 is a perspective view of an elevating apparatus constructed in accordance with one embodiment of the invention.
Figure 7:
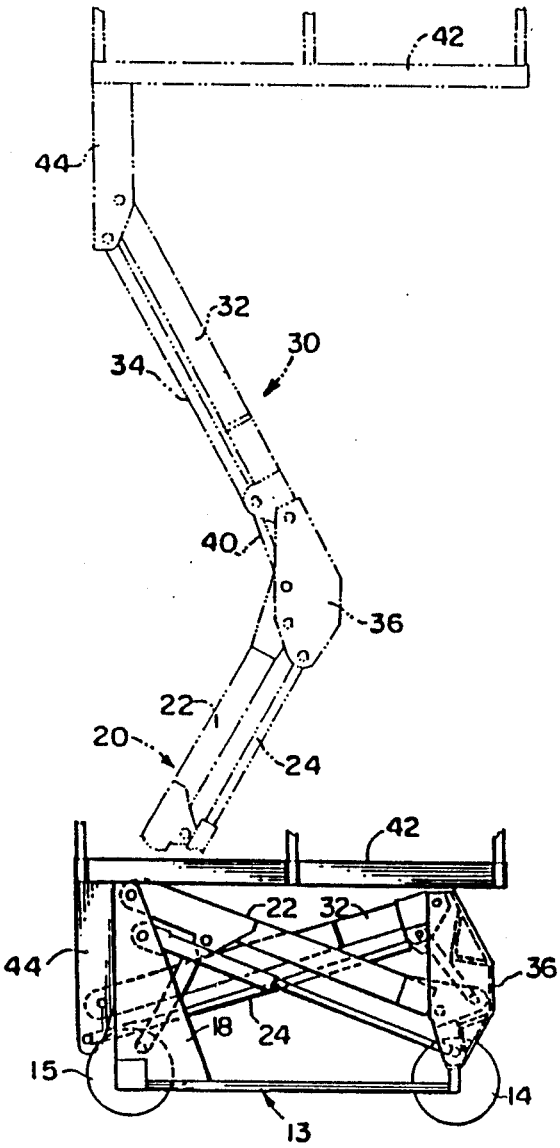
FIG. 7 is a side elevational view illustrating the apparatus in FIG. 1 in both the fully extended (broken lines) and retracted (solid lines) positions.

Referring to the drawings, FIG. 1 generally illustrates one embodiment of the present invention, the elevating apparatus 10, in a partially extended position. FIG. 7 illustrates apparatus 10 in both the fully extended position, shown in broken lines, and in the compact fully retracted or stored position, shown in solid lines.

Apparatus 10 includes a support base 12 which is further comprised of a support frame 13 and a boom head 18. Preferably, the apparatus 10 is mobile in which case the support frame includes pneumatic tired front wheels 14 and pneumatic tired rear wheels 15. Preferably, at least one wheel is driven by a suitable motor, not shown. The front wheels are preferably steerable and attached to the support frame by a four-link steering linkage 16 which is operated by suitable means such as hydraulic steering cylinder 17. A heavy plate 19, made for instance of steel, mounted on the bottom of the support frame maintains apparatus 10 in equilibrium even when it is fully extended to its maximum height carrying a full capacity load. Boom head 18, preferably U-shaped in cross-section perpendicular to its major axis, has a fixed end fixedly connected to the support frame, and a distal end to which are pivotally connected the pivot ends of two components of the first boom assembly 20, namely, first boom 22 and first control arm 24. Throughout the text of this application, the term "pivotally connected" refers to the connection of one component to another by use of a connector pin. For example, a connector pin pivotally connects first boom 22 with boom head 18 at 48, and a pin connects the boom 22 to the coupler at 49.

Figure 3:
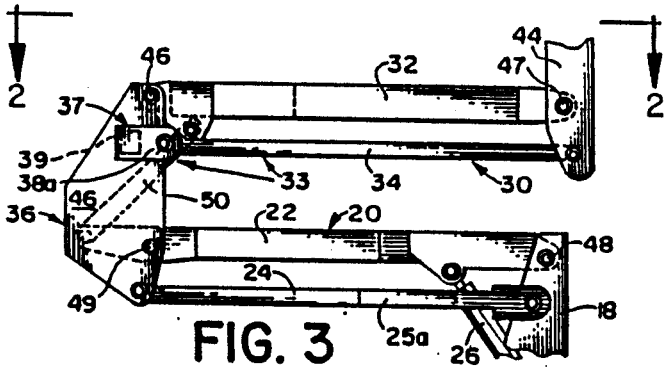
FIG. 3 is a fragmentary side elevational view illustrating the first and second boom assemblies as operatively interconnected by the boom assembly coupler and rigid compression link.

Referring to FIGS. 1 and 3, the elongated first boom assembly 20 is comprised of the elongated first boom 22 and the elongated first control arm 24, each having a distal end and a pivot end. First boom 22 and first control arm 24 are of substantially equal length and are in a substantially parallel relationship with one another. The pivot ends of first boom 22 and first control arm 24 are pivotally connected to the support base 12, preferably at the boom head 18, such that the first boom assembly 20 is movable in a vertical plane between a multiplicity of positions ranging from a downwardly declining limit position to an upwardly inclining limit position.

Boom assembly coupler 36 is of the single-frame type and is pivotally connected to the distal ends of the first boom 22 and the first control arm 24 such that boom head 18, first boom 22, first control arm 24, and boom assembly coupler 36 are so interconnected as to form a parallelogram.

A lifting means operatively connected to first boom 22 allows first boom assembly 20 to move between a multiplicity of positions ranging from a downwardly declining limit position to an upwardly inclining limit position. Preferably, said lifting means is comprised of at least one hydraulic lifting cylinder 26 pivotally connected between the support base 12, preferably at boom head 18, and the first boom 22. The hydraulic cylinder would preferably be actuated by hydraulic control means, which those skilled in the art will readily understand and which is thus not shown in FIG. 1, for regulating the amount and pressure of hydraulic fluid within said hydraulic lifting cylinder.

The pivot end of first control arm 24 is preferably bifurcated, having two legs (one of which is seen at 25*a*)

of equal length and being in a parallel, spaced-apart relationship to one another, thus allowing hydraulic lifting cylinder 26 to operate therebetween.

An elongated second boom assembly 30 is comprised of an elongated second boom 32 and a second control arm assembly 33. Second boom 32 has a pivot end and a distal end, the pivot end is pivotally connected to boom assembly coupler 36 at 46 and the distal end is laterally offset from the pivot end of the first boom assembly 20 to afford movement of the distal end of the second boom between opposite limit positions corresponding to the limit positions of first boom assembly 20. This lateral offset affords travel of the second boom distal end past the pivot end of the first boom assembly as the boom assemblies move from the upwardly inclining positions to the downwardly declining positions, thus allowing apparatus 10 to be foldable into the compact retracted or stored position illustrated in FIG 7. This advantageous feature permits easy transportation and stowage of the apparatus in areas of limited height and width. Preferably the lateral offset feature is achieved by manufacturing second boom 32 in a substantially Z-shaped form (see FIG. 2).

The second control arm assembly 33 includes an elongated, straight second control arm 34 having a pivot end and a distal end, and second control arm pivot means for pivotally connecting the pivot end of the second control arm to the boom assembly coupler such that said pivot end is laterally offset from the second boom pivot end by a distance less than the offset of the distal end of the second boom from its pivot end, so as to be out of said vertical plane of movement of the first boom. Second control arm 34 is substantially equidistant from second boom 32 and is angularly disposed with respect to said vertical plane of movement of the first boom assembly.

Figure 2:
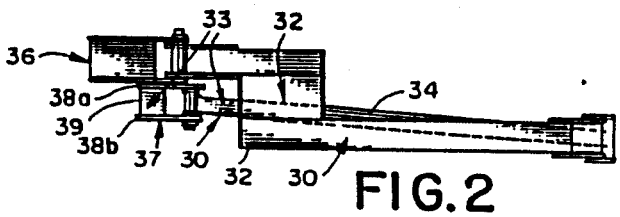
FIG. 2 is a fragmentary plan view illustrating the boom assembly coupler and second boom assembly.

As illustrated in FIGS. 1–3, the second control arm pivot means preferably includes a U-shaped second control arm pivot bracket or pivot mounting connection 37 having two flat, substantially parallel, spaced-apart sidewalls **38*a* and 38*b* and a square tubular spacer 39 welded therebetween to form a closed end of the U-shaped bracket, the other end being open. One sidewall of second control arm pivot bracket 37 is fixedly mounted on a side of the boom assembly coupler 36 proximate to the laterally offset distal end of second boom 32. The pivot end of second control arm 34 is pivotally mounted between said sidewalls 38*a* and 38*b* at the open end of said bracket and is axially offset from the pivot point 46. From the bracket 37, the arm 34 angles outwardly generally parallel to the boom 32 and is pivoted at its distal end to a work station support member 44 adjacent the pivot point 47 at the distal end of the boom 32**.

The design of the second control arm assembly in accordance with the present invention is advantageous in at least several ways. First, such design permits the apparatus to have the desirable foldable feature. Second, the offset pivot bracket 37 allows the use of a rigid compression link 50 to span directly between the booms 22 and 32 in conjunction with a single-frame boom assembly coupler 36. Third, these advantages are readily achieved by inexpensive manufacturing techniques because the second control arm of the present invention is a simple, one-piece unit, easily fabricated without use of costly forming and assembling operations.

The work station support member 44, having a rigid end and a pivot end, supports work station 42. The rigid end of the work station support member is rigidly connected to said work station and the pivot end of said work station support member is pivotally connected to the distal end of the second boom assembly 30, specifically to the distal ends of both second boom 32 and second control arm 34. Thus, boom assembly coupler 36 and second control arm pivot bracket 37, second boom 32, second control arm 34 and work station support member 44 form a parallelogram so that, working in conjunction with the parallelogram characteristic of first boom assembly 20, the work station is maintained in a level attitude throughout the range of movement of said first and second boom assemblies.

A rigid compression link 50 operatively interconnects, within the vertical plane of movement of the first boom, the distal end of first boom 22 and the pivot end of second boom 32 such that movement of the first boom assembly causes movement of the second boom assembly.

Figure 4:
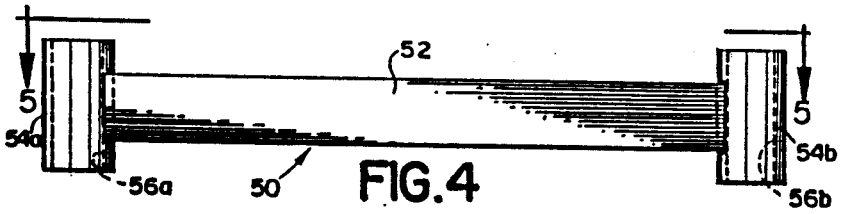
FIG. 4 is a plan view of the rigid compression link.
Figure 5:
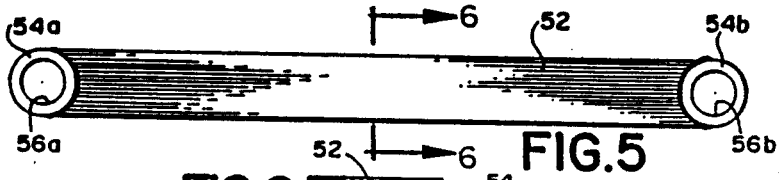
FIG. 5 is a side elevational view of the rigid compression link.
Figure 6:
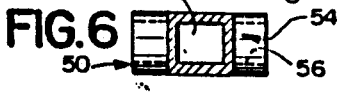
FIG. 6 is a cross-sectional view along line 6—6 of FIG. 5.

Referring to FIGS. 4–6, rigid compression link 50 is preferably constructed from a tubular, elongate member 52 of a hollow square cross-section, having two ends, and of two cylindrical end sleeves **54*a* and 54*b* each welded to one of said ends of said elongate member with the cylindrical axis of each end sleeve disposed perpendicular to the longitudinal axis of said tubular elongate member. End sleeves 54*a* and 54*b* each contain a bore, 56*a* and 5*b* respectively, to accommodate suitable connector pins. The wall thickness of elongate member 52** must be of sufficient wall thickness to withstand a determined amount of stress.

Rigid compression link 50 is preferably of sufficient length and is pivotally connected at each end in such a manner so that when the first boom assembly 20 undergoes angular movement, the second boom assembly undergoes an equal degree of angular movement thereby displacing work station 42 only in a substantially vertical direction thereby allowing accurate placement of the apparatus in the work area before elevation without the need to adjust the apparatus ground position thereafter.

Utilization of rigid compression link 50 in the manner discussed above provides the present invention with a number of advantages over the use of gears, chains, cables, or tension links. The integrity of the compression link is not as weld-quality sensitive as that of a tension link. A compression-link-containing apparatus is less complex and more economical to manufacture than apparatus utilizing gears, chains, or cables, and unlike the latter, requires no periodic linkage field adjustment by skilled personnel, thus increasing apparatus reliability while decreasing personnel training costs. By virtue of its simple, tubular construction, compression link 50 contributes to a lighter overall apparatus weight than some other designs, thereby allowing the use of less capacious and/or complex lifting means and lighter, less complex means of stabilizing the apparatus in the extended position. Additionally, compression link 50 provides simple, reliable automatic synchronization of the first and second boom assemblies thereby eliminating the cost and difficulties associated with the use of multiple hydraulic cylinders for this function.

Operation of the preferred embodiment of the present invention illustrated in FIGS. 1 and 7 usually commences with the first boom assembly 20, the second boom assembly 30, and work station 42 in the retracted or stored position. The operator, standing in work station 42 manipulates simple hydraulic controls, not shown, causing extension of hydraulic lifting cylinder 26, which in turn causes the upwardly inclining angular movement of first boom assembly 20 relative to support base 12. Second boom assembly 30, operatively connected to the first boom assembly by rigid compression link 50, is caused to upwardly incline, relative to boom assembly coupler 36, in a manner directionally opposite, but equal in degree to, that of the first boom assembly. Thus, work station 42 is raised vertically unaccompanied by any substantial horizontal displacement while being maintained in a level attitude throughout the range of motion of the apparatus. The work station may be lowered by simply reversing of the above-described operation, and may be raised or lowered to any position intermediate between the fully extended and retracted or stored limit positions.

While certain preferred embodiments of the present invention have been illustrated and described, the present invention is not limited thereto but may be variously modified or embodied within the scope of the following claims. In particular, as will be readily understood by those of ordinary skill in the art, the present invention contemplates embodiments with more than two boom assemblies and a suitable number of compression links operatively interconnecting them.

What is claimed is:

1. An elevating apparatus having a stored position and multiple extended positions comprising a support base;

a first boom assembly including an elongated first boom and an elongated first control arm of length substantially equal thereto and in a substantially parallel relationship therewith, said first boom and said first control arm each having a distal end and a pivot end, the pivot end being pivotally connected to said support base such that the first boom assembly is movable in a vertical plane between a multiplicity of positions ranging from a downwardly declining limit position to an upwardly inclining limit position;

a lifting means operatively connected to said first boom;

a boom assembly coupler pivotally connected to the distal ends of the first boom and the first control arm;

a second boom assembly including an elongated second boom and a second control arm assembly, said second boom having a pivot end pivotally connected to said boom assembly coupler and having a distal end laterally offset from said pivot end of said first boom assembly to afford movement of said distal end of the second boom between opposite limit positions corresponding to the limit position of said first boom assembly, said offset affording travel of the second boom distal end past the pivot end of the first boom assembly as the boom assemblies move from the upwardly inclining positions to the downwardly declining positions, said second control arm assembly including an elongated, straight second control arm having a pivot end and a distal end, and second control arm pivot means for pivotally connecting the pivot end of said second control arm to said boom assembly coupler such that said pivot end is laterally offset from the second boom pivot end by a distance less than the offset of the distal end of the second boom from its pivot end, so as to be out of said vertical plane of movement of the first boom, said second control arm pivot means including a pivot mounting connection, said pivot mounting connection being fixedly mounted on a side of the boom assembly coupler proximate to said laterally offset distal end of the second boom, the pivot end of said second control arm being pivotally mounted at the pivot mounting connecting so as to be axially offset from the pivot of said second boom, said second control arm further being substantially equidistant from said second boom and angularly disposed with respect to said vertical plane of movement of the first boom assembly;

a rigid compression link operatively interconnected within said vertical plane between the distal end of said first boom and the pivot end of said second boom such that the movement of the first boom assembly causes movement of the second boom assembly;

a workstation; and a workstation support member with a rigid end rigidly connected to said workstation and a pivot end pivotally connected to the distal end of the second boom assembly such that said workstation remains in a level attitude throughout the range of movement of said first and second boom assemblies.

2. An elevating apparatus having a stored position and multiple extended positions comprising a support base;

a first boom assembly including an elongated first boom and an elongated first control arm of length substantially equal thereto and in a substantially parallel relationship therewith, said first boom and said first control arm each having a distal end and a pivot end, the pivot end being pivotally connected to said support base such that the first boom assembly is movable in a vertical plane between a multiplicity of positions ranging from a downwardly declining limit position to an upwardly inclining limit position;

a lifting means operatively connected to said first boom;

a boom assembly coupler pivotally connected to the distal ends of the first boom and the first control arm;

a second boom assembly including an elongated second boom and a second control arm assembly, said second boom having a pivot end pivotally connected to said boom assembly coupler and having a distal end laterally offset from said pivot end of said first boom assembly to afford movement of said distal end of the second boom between opposite limit positions corresponding to the limit positions of said first boom assembly, said offset affording travel of the second boom distal end past the pivot end of the first boom assembly as the boom assemblies move from the upwardly inclining positions to the downwardly declining positions, said second control arm assembly including an elongated, straight second control arm having a pivot end and a distal end, and second control arm pivot means for pivotally connecting the pivot end of said second control arm to said boom assembly coupler such that said pivot end is laterally offset from the second boom pivot end by a distance less than the offset of the distal end of the second boom from its pivot end, so as to be out of said vertical plane of movement of the first boom, said second control arm pivot means including a U-shaped second control arm pivot bracket having two flat, substantially parallel, spaced-apart sidewalls and a square tubular spacer welded therebetween to form a closed end of the U-shaped second control arm pivot bracket, the other end being open, one sidewall fixedly mounted on a side of the boom assembly coupler proximate to said laterally offset distal end of the second boom, the pivot end of said second control arm pivotally mounted between said sidewalls at the open end of said second control arm pivot bracket so as to be axially offset from the pivot of said second boom, said second control arm further being substantially equidistant from said second boom and angularly disposed with respect to said vertical plane of movement of the first boom assembly;

rigid compression link operatively interconnected within said vertical plane between the distal end of said first boom and the pivot end of said second boom such that the movement of the first boom assembly causes movement of second boom assembly;

a workstation; and a workstation support member with a rigid end rigidly connected to said workstation and a pivot end pivotally connected to the distal end of the second boom assembly such that said workstation remains in a level attitude throughout the range of movement of said first and second boom assemblies.

3. An elevating apparatus having a stored position and multiple extended positions comprising a support base;

a first boom assembly including an elongated first boom and an elongated first control arm of length substantially equal thereto and in a substantially parallel relationship therewith, said first boom and said first control arm each having a distal end and a pivot end, the pivot end being pivotally connected to said support base such that the first boom assembly is movable in a vertical plane between a multiplicity of positions ranging from a downwardly inclining limit position to an upwardly inclining limit position;

a lifting means operatively connected to said first boom;

a boom assembly coupler pivotally connected to the distal ends of the first boom and the first control arm;

a second boom assembly including an elongated second boom and a second control arm assembly, said second boom having a pivot end pivotally connected to said boom assembly coupler and having a distal end laterally offset from said pivot end of said first boom assembly to afford movement of said distal end of the second boom between opposite limit positions corresponding to the limit positions of said first boom assembly, said offset affording travel of the second boom distal end past the pivot end of the first boom assembly as the boom assemblies move from the upwardly inclining positions to the downwardly declining positions, said second control arm assembly including an elongated straight second control arm having a pivot end and a distal end, and second control arm pivot means for pivotally connecting the pivot end of the second control arm to said boom assembly coupler such that said pivot end is laterally offset from the second boom pivot end by a distance less than the offset of the distal end of the second boom from its pivot end, so as to be out of said vertical plane of movement of the first boom, said second control arm further being substantially equidistant from said second boom and angularly disposed with respect to said vertical plane of movement of the first boom assembly;

a rigid compression link operatively interconnected within said vertical plane between the distal end of said first boom and the pivot end of said second boom such that the movement of the first boom assembly causes movement of the second boom assembly, the rigid compression link including a tubular, elongated member of a hollow cross-section, having two ends, said member having a wall thickness sufficient to withstand a predetermined amount of stress; and two cylindrical end sleeves each welded to one of said ends of said elongate member with the cylindrical axis of each end sleeve disposed perpendicular to the longitudinal axis of said tubular elongate member;

a workstation; and a workstation support member with a rigid end rigidly connected to said workstation and a pivot end pivotally connected to the distal end of the second boom assembly such that said workstation remains in a level attitude throughout the range of movement of said first and second boom assemblies.

4. An elevating apparatus as described in claim 3 wherein said rigid compression link is of sufficient length and is pivotally connected at each end in such a manner so that when the first boom assembly undergoes angular movement, the second boom assembly undergoes an equal degree of angular movement thereby substantially displacing said workstation only in the vertical direction.

* * * * *